US005999758A

United States Patent [19]

Rai et al.

[11] Patent Number: 5,999,758

[45] Date of Patent: Dec. 7, 1999

[54] HYBRID HIERARCHICAL CONTROL ARCHITECTURE FOR MEDIA HANDLING

[75] Inventors: Sudhendu Rai, Pennfield, N.Y.; Warren B. Jackson, San Francisco; David K. Biegelsen, Portola Valley, both of Calif.; Barry Wolf, Yorktown Heights, N.Y.

[73] Assignee: Xerox Corporation, Stamford, Conn.

[21] Appl. No.: 09/033,152

[22] Filed: Mar. 2, 1998

[51] Int. Cl.[6] ..... G03G 15/00; G03G 21/00

[52] U.S. Cl. ..... 399/16; 271/259; 271/265.02; 399/381

[58] Field of Search ..... 399/16, 9, 18, 399/19, 20, 76, 361, 381; 271/256, 258.01, 259, 264, 265.01, 265.02, 270; 364/478.01

[56] References Cited

U.S. PATENT DOCUMENTS 5,010,551 4/1991 Goldsmith et al. ..... 399/16 X 5,142,340 8/1992 Farrell et al. ..... 399/327

5,257,070 10/1993 Miller et al. ..... 399/20

5,328,168 7/1994 Fox ..... 271/259

*Primary Examiner*—Sandra Brase

*Assistant Examiner*—Sophia S. Chen

*Attorney, Agent, or Firm*—Ronald F. Chapuran

[57] ABSTRACT

A method of controlling the movement of copy sheets along a copy sheet path by providing a target by a high level controller for the movement of copy sheets within the copy sheet path and controlling movement of copy sheets within segments of the copy sheet path. Movement in each segment is controlled by subcontrollers activating segment drives. Feedback data are conveyed to the high level controller and to other subcontrollers on the movement of copy sheets within segments of the copy sheet path and copy sheet movement is adjusted by the copy sheet drives of selected segments of the copy sheet path in order to achieve the target.

24 Claims, 4 Drawing Sheets

HYBRID HIERARCHICAL CONTROL ARCHITECTURE FOR MEDIA HANDLING

FIELD OF THE PRESENT INVENTION

The present invention is directed to control in a sheet handling system, and more specifically, to the use of pre-planned trajectories and the use of a hierarchical approach for causing the sheets to follow the trajectories using feedback control by individual actuators.

BACKGROUND OF THE PRESENT INVENTION

The goal of a paper path system in a typical xerographic printing system is to transport media from a feeding unit in synchronism with a moving image bearing photoreceptor surface. The media necessarily must arrive at the transfer zone at a given time and with a given velocity to match the velocity of the image bearing photoreceptor surface. Traditional media handling systems have relied on the use of expensive and precisely manufactured actuators (such as roller transports) for moving media such as paper and transparencies with very little or no feedback control involved. These systems typically do not perform very well when subjected to handling a wide range of media as well as exhibit problems with maintaining accuracy and reliability at high speeds. The present invention uses a more control-centric design of media handling systems that takes advantage of the diamatic decrease in chip cost and moves away from parts requiring high tolerance. It does so by embedding more controls in the system and trimming the overall cost by reducing the cost of hardware. The invention also enables significantly better performance by being able to handle a wider range of media at higher speeds through effective use of modern control strategies. Also prior art systems are often open loop systems with the media running at a specific speed and position adjustment being made at a transfer registration station just prior to transfer. A difficulty with such systems is the often erratic and abrupt adjustments that must be made at the registration station due to the unpredictability of photoreceptor and media drives and the uncertainty of the position of the image on the photoreceptor. With little time and space for adjustment, the correction can be erratic. This is particularly true in higher speed, higher volume machines.

It is known in the prior art, for example, U.S. Pat. Nos. 5,328,168 and 5,257,070 to selectively activate copy sheet drives after a machine jam in order to position copy sheets for favorable jam clearance including the steps of maintaining a predetermined interdocument space between copy sheets and systematically purging copy sheets from zones of the paper path in a predetermined order. A difficulty with these prior art systems, however, is the restriction of the systems to jam recovery. It would be desirable, therefore, to provide a relatively smooth and more accurate adjustment technique over the entire paper path to synchronize the arrival of copy sheets and images on a photoreceptor at an image transfer station.

It is an object of the present invention, therefore, to provide a multi-layered hybrid hierarchical control architecture for media handling. It is another object of the present invention to provide a combination of modular, discrete and continuous controllers that interact with copy sheets as the copy sheets move along a paper path. It is still another object of the present invention to provide a discrete controller to plan distance-time trajectories for media on a media path and to provide continuous controllers for keeping the media on the respective trajectories using multi-layered architecture. Further advantages of the present invention will become apparent as the following description proceeds, and the features characterizing the invention will be pointed out with particularity in the claims annexed to and forming a part of this specification.

SUMMARY OF THE PRESENT INVENTION

This invention describes a method of controlling the movement of copy sheets along a copy sheet path by providing a target by a high level controller for the movement of copy sheets within segments of the copy sheet path and controlling the movement of copy sheets within the segments of the copy sheet path. Movement in each segment is controlled by subcontrollers activating segment drives. Feedback data are conveyed to the high level controller and to other subcontrollers on the movement of copy sheets within segments of the copy sheet path and copy sheet movement is adjusted by the copy sheet drives of selected segments of the copy sheet path in order to achieve the target.

BRIEF DESCRIPTION OF THE DRAWINGS

The following is a brief description of the drawings used to describe the present invention, and thus, these drawings are being presented for illustrative purposes only and thus should not be limitative of the scope of the present invention, wherein.

DETAILED DESCRIPTION OF THE PRESENT INVENTION

Figure 1:
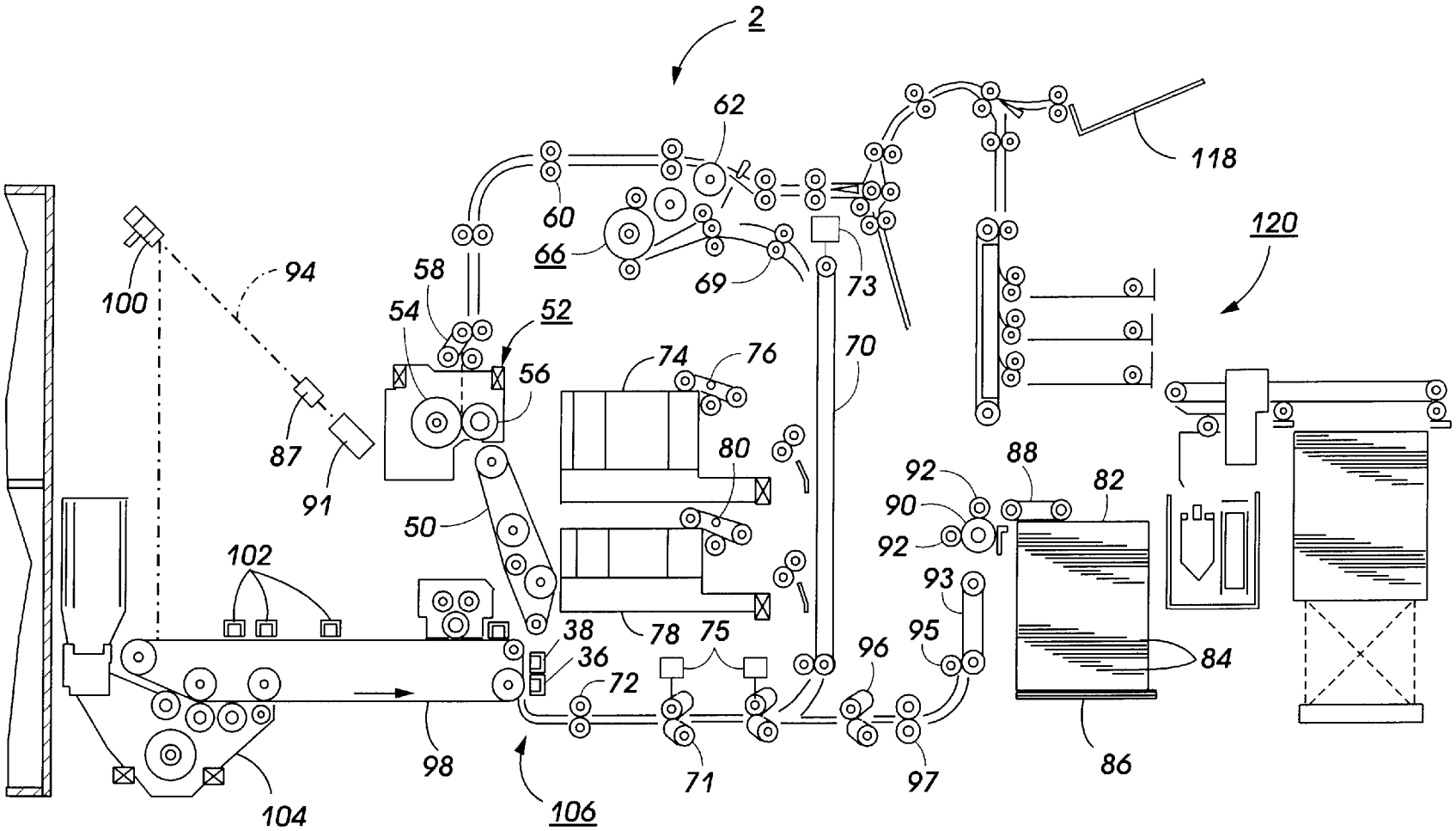
FIG. 1 is a plan view illustrating a typical printing system incorporating the present invention.

Referring to FIG. 1, there is shown an exemplary laser based printing system 2 for processing print jobs in accordance with the teachings of the present invention. Printing system 2 for purposes of explanation is divided into a controller section and a printer section. While a specific printing system is shown and described, the present invention may be used with other types of printing systems such as ink jet, ionographic, etc.

The printer section comprises a laser type printer and for purposes of explanation is separated into a Raster Output Scanner (ROS) section, Print Module Section, Paper Supply Section, and Finisher. The ROS has a laser 91, the beam of which is split into two imaging beams 94. Each beam 94 is modulated in accordance with the content of an image signal input by acousto-optic modulator 87 to provide dual imaging beam 94. Beams 94 are scanned across a moving photoreceptor 98 of the Print Module by the mirrored facets of a rotating polygon 100 to expose two image lines on photoreceptor 98 which each scan and create the latent electrostatic images represented by the image signal input to modulator 87. Photoreceptor 98 is uniformly charged by corotrons 102 at a charging station preparatory to exposure by imaging beams 94. The latent electrostatic images are developed by developer 104 and transferred at transfer station 106 to print media delivered by the Paper Supply section. Print media, as will appear, may comprise any of a variety of sheet sizes, types, and colors. For transfer, the print media or copy sheet is brought forward in timed registration with the developed image on photoreceptor 98 from either a main paper tray high capacity feeder 82 or from auxiliary or secondary paper trays 74 or 78.

A copy sheet is provided via de-skew rollers 71 and copy sheet feed roller 72. At the transfer station 106, the photoconductive belt 98 is exposed to a pretransfer light from a lamp (not shown) to reduce the attraction between photoconductive belt and the toner powder image. Next, a corona generating device 36 charges the copy sheet to the proper magnitude and polarity so that the copy sheet is tacked to photoconductive belt and the toner powder image attracted from the photoconductive belt to the copy sheet. After transfer, corona generator 38 charges the copy sheet to the opposite polarity to detack the copy sheet from belt.

Following transfer, a conveyor 50 advances the copy sheet bearing the transferred image to the fusing station where a fuser assembly indicated generally by the reference numeral 52 permanently affixes the toner powder image to the copy sheet. Preferably, fuser assembly 52 includes a heated fuser roller 54 and a pressure roller 56 with the powder image on the copy sheet contacting fuser roller 54.

After fusing, the copy sheets are fed through a decurler 58 to remove any curl. Forwarding rollers 60 then advance the sheet via duplex turn roll 62 to a gate which guides the sheet to output tray 118, finishing station 120 or to duplex inverter 66. The duplex inverter 66 provides a temporary wait station for each sheet that has been printed on one side and on which an image will be subsequently printed on the opposite side. Each sheet is held in the duplex inverter 66 face down until feed time occurs.

To complete duplex copying, the simplex sheet in the inverter 66 is fed back to the transfer station 106 via conveyor 70, de-skew rollers 71 and paper feed rollers 72 for transfer of the second toner powder image to the opposed sides of the copy sheets. The duplex sheet is then fed through the same path as the simplex sheet to be advanced to the finishing station which includes a stitcher and a thermal binder.

Copy sheets are supplied from the secondary tray 74 by sheet feeder 76 or from secondary tray 78 by sheet feeder 80. Sheet feeders 76, 80 are friction retard feeders utilizing a feed belt and take-away rolls to advance successive copy sheets to transport 70 which advances the sheets to rolls 72 and then to the transfer section.

A high capacity feeder 82 is the primary source of copy sheets. Tray 84 of feeder 82 is supported on an elevator 86 for up and down movement and has a vacuum feed belt 88 to feed successive uppermost sheets from the stack of sheets in tray 84 to a take away drive roll 90 and idler rolls 92. Rolls 90, 92 guide the sheet onto transport 93 which in cooperation with idler roll 95, de-skew rollers 96 and paper feed rollers 97 move the sheet to the transfer station via deskew rollers 71 and feed rollers 72.

Figure 2:
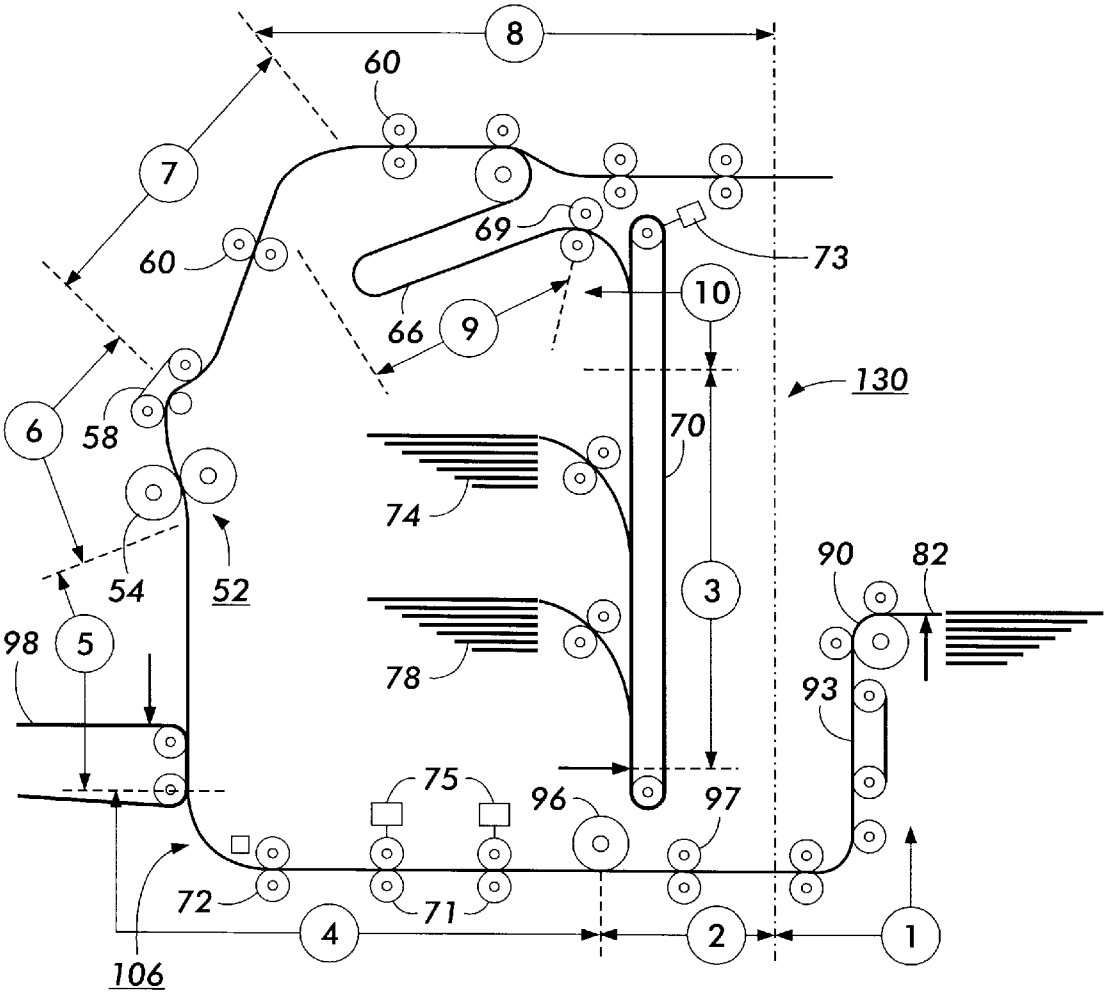
FIG. 2 is an extended view of the copy sheet path.

With reference to FIG. 2 an enlarged sketch of the copy sheet path is illustrated with ten predetermined copy sheet paths zones. The zones are identified by the circled numbers, and are defined by the arrows extending from the circled numbers between dotted lines. The dashed line 130 illustrates the interface between the copy handling module and the finisher station 120 (Comment: 120 is not shown in FIG. 2). Zones 1 and 2 illustrate the copy sheet path from the high capacity feeder 82 to roller 96, zone 3 illustrates the copy sheet path along conveyor or transport 70, zone 4 illustrates the copy sheet path from the de-skew rollers 71 to the transfer station, 106. Zone 5 illustrates the copy sheet path between the transfer station and the fuser 52, zone 6 illustrates the copy sheet path from the fuser to decurler 58, zone 7 illustrates the copy sheet path between the decurler 58 and the rollers 60, zone 8 illustrates the copy sheet path from the rollers 60 to the finishing station, zone 9 illustrates the copy sheet path from the duplex invertor 66 to the duplex feed rolls, and zone 10 illustrates the copy sheet path between the duplex feed rolls 69 and the top of the conveyor 70.

It should be noted that the partitions of the copy sheet path into the zones is arbitrary. However, in accordance with the present invention, certain portions of the copy sheet path are independently driven and are adapted to be selectively turned on or off through the operation of motor, solenoids and clutch mechanisms. For example, a suitable clutch 73 mechanically connected to the transport or conveyor 70 controls the movement of the conveyor 70 and suitable solenoids 75 operate to selectively engage and disengage the de-skew rollers 71.

The goal of the media handling system is described as taking a sheet of paper and moving it from one point in the paper path to another while performing one or more operations (such as inversion, transfer, fusing) in between. The traditional implementation is to use timing signals to coordinate all these activities. For example, the sheet is fed in at a certain time according to a timing signal received, it moves through the paper path and arrives at different position sensors on the paper path within a certain time window and arrives at the transfer station at a specific time. Any temporal error in the operations beyond a certain tolerance is detected and flagged to the machine resulting in a shutdown. Another problem with the traditional systems is their inability to handle a wide range of media and operate reliably and accurately at very high speeds.

In accordance with the present invention, a control system is provided that consists of (one or more) system controllers such as Controller 200 that plans trajectories for the media from its entrance in the paper path to its exit. The trajectories describe how the media move on the paper path as a function of time. One or more local controllers 202, 204, 206, 208 1nd 210 determine the actuation required to track the trajectories. One or more modular actuators 202A, 204A, 206A, 208A, and 210A are then used to move the media on the trajectories specified by the controller. A schematic view of the architecture is shown in FIG. 3.

In other words, there is the use of pre-planned trajectories and a hierarchical approach for causing the sheets to follow the trajectories using feedback control by individual actuators. The individual actuators have their own local controllers which accept the trajectories from the high-level controller and keep the media on the desired trajectories. In turn, the actuators communicate with the trajectory planner and other actuators if necessary to monitor sheets to be able to trade the trajectories appropriately.

The actuator modules can be performing generic tasks such as moving paper, inverting paper, decurling paper, transferring image, fusing, etc. Each task has a corresponding description in distance-time and the overall trajectory planning is done keeping the constraints imposed by each module task. For example, a sheet in an inverter may be described by a dwell-time and that will correspond to a horizontal line in the distance-time trajectory. Another example, is the situation when a sheet is simultaneously in two transport modules and that can be described as a trajectory that has the same slope (i.e. velocity) in the distance region specified for both modules. The trajectory therefore acts as an effective means of embedding the constraints involved in moving the media on the paper path.

Figure 3:
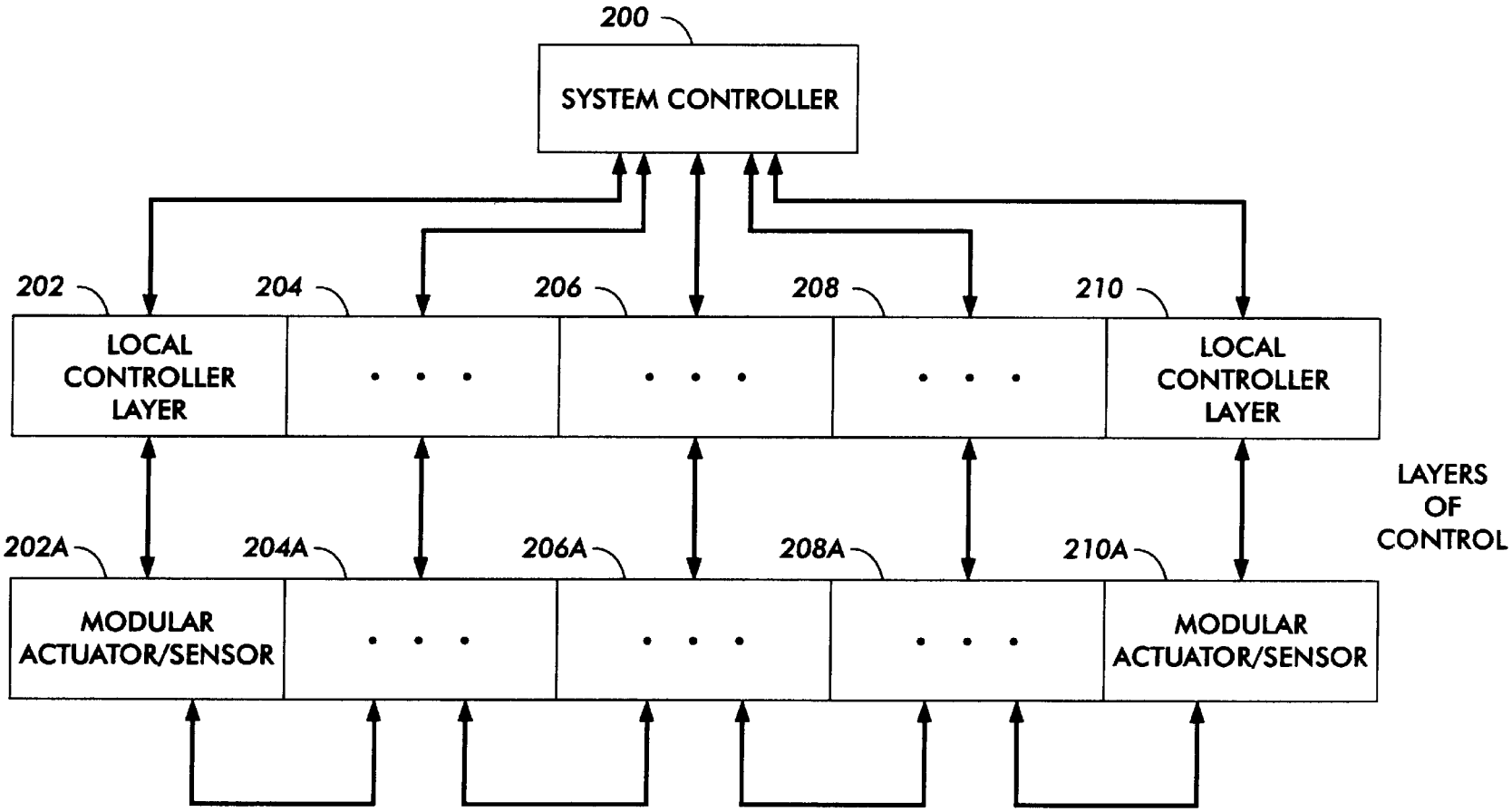
FIG. 3 is schematic representation of a multi-layered hybrid hierarchical control architecture for media handling in accordance with the present invention.

The communication links shown in FIG. 3 are used to communicate trajectory and sheet position information back and forth between the module controllers, the system controller and/or any other intermediate controller in the overall system. The bidirectional flow of information is used to make corrections to the trajectories in real-time to ensure that conflicts between the multiple sheets in the paper path are resolved as and when they appear. For example, if two sheets begin to get too close, the information is sensed and trajectories are replanned appropriately either by the modules themselves or by the supervisory system controller(s). The new trajectories are then communicated to the appropriate modules and the modules in turn change their actuation to track the new trajectory.

The use of active feedback control in tracking trajectories addresses the problem of handling different types of media. The control algorithms have parameters that depend on the media properties and they are adjusted in real-time depending on the media types. This can be done by inputting the media properties to the system or in many cases by learning the media properties online. In addition, the use of active feedback control for moving media brings inherent robustness to the system by making the system less sensitive to environmental changes such as temperature and humidity and to wear of components.

For high productivity, it is necessary to move media at higher speeds. The architecture proposed above uses feedback control for keeping media on desired trajectories. The use of active sensing and feedback control guarantees that the deviations from desired trajectories will be corrected in real-time and that the media will be moved with high accuracy. Also, since the media movement is monitored in real-time, whenever a situation arises that a jam may occur, it is detected by the system and the trajectories are replanned to avoid the jam. If the situation is not amenable to correction, the machine comes to a graceful halt. The use of more active feedback control for handling media reduces the need for accuracy in manufacturing the actuators. It is possible to do media handling with less precisely manufactured actuators since the accuracy is maintained by sensing and controls. Because the cost of the controllers ("silicon") is going down fast and the cost of precision hardware ("iron") is fairly flat, the overall cost of the proposed architecture eventually will be lower.

Figure 4:
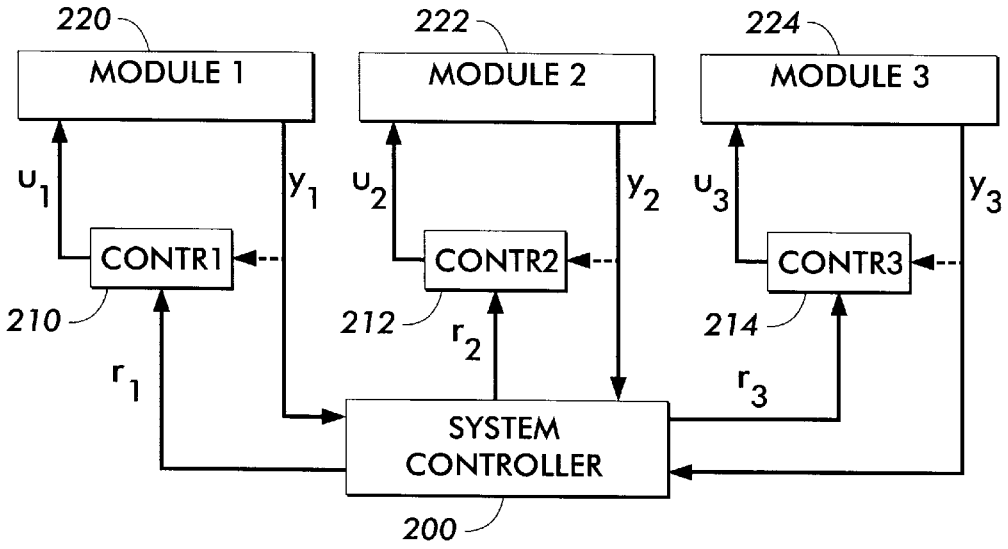
FIG. 4 is a schematic diagram of a system control architecture according to the present invention.

A system control architecture is shown in FIG. 4, the system controller interacts with the individual controllers of the modular actuators that are arranged all along the paper path to move the sheet of paper. The system controller 200 determines the desired trajectory denoted by $r_1$, $r_2$, and $r_3$ that each sheet should track and passes it to the individual modules 220, 222, 224. The individual or local module controllers 210, 212, and 214 determine the actuation (denoted by $u_1$, $u_2$, and $u_3$) to be applied to track the trajectory to a specified accuracy. The actual position of the sheets (either measured or estimated by a deterministic observer such as Luenberger observer or a stochastic observer such as Kalman filter) is denoted by $y_1$, $y_2$, and $y_3$.

The local module controllers provide continuous feedback and receive the reference trajectory information from the high level system controller 200 and use actuation to keep sheets on the trajectory. The only requirements for the local module controllers are to be stable and have enough actuation to keep the sheet on the desired reference trajectory. An example of such a controller for an airjet transport module (a paper transport which uses flowing air, instead of rollers, to apply the motive force to the media) is a sliding mode controller that performs one-dimensional (along the paper path) control of a sheet by controlling the flow of air through the module. Another example, is a conventional roller transport module that transports sheets from one module to another where the speed of the rollers is controlled.

It is preferred that the constraints that exist between individual sheets and the modules are embedded (to whatever extent) in the reference trajectory itself. Thus the individual modules are always trying to track a given reference trajectory only and are not concerned with managing constraints that may arise due to events that take place in down stream modules.

To effectively accomplish this situation, the system level controller needs to be aware of various capabilities of the individual modules that will be specified in the interface. In particular, the system level controller should be aware of the entrance and exit points of the module (i.e. the length of the individual module) and the maximum accelerating and retarding forces that the controller can apply to a given sheet. Also, if this is a function of the sheet length in the module (as it might be in the case of air-jet) that should be specified too. Also, the settling time of the controller to a unit step response in position should be specified (this can be used as a measure of the response time of the module controller). The reference trajectory may require modifications if something goes wrong (such as when a jam occurred and the system shuts down). Hence, it is required for the system controller to keep track of the position of each sheet as it moves along the paper path.

Figure 5:
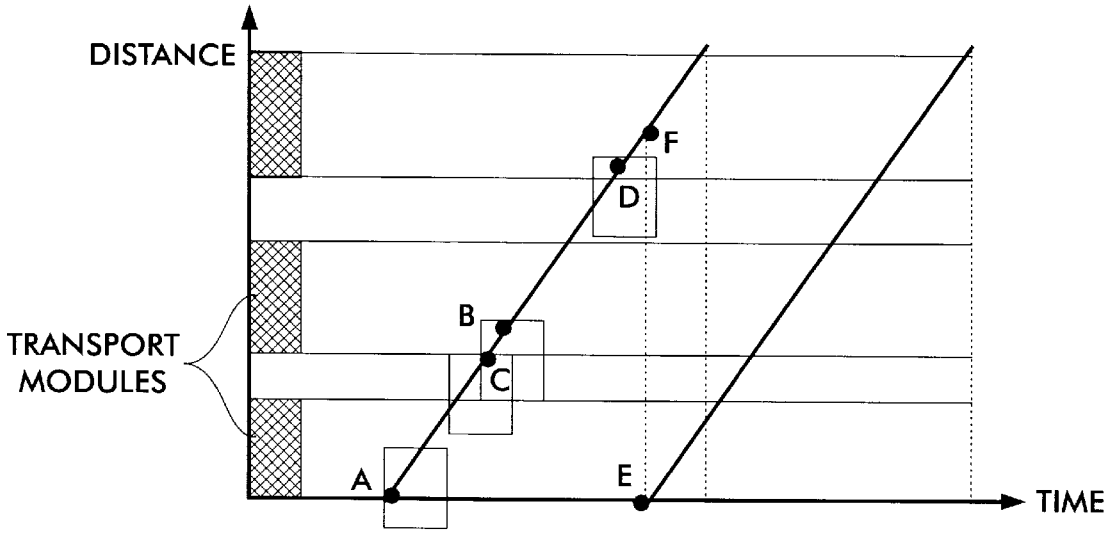
FIG. 5 illustrates distance-time trajectories for two different sheets according to the present invention.

The system controller 200 determines the reference (or nominal) trajectory of each sheet. To do this it uses the information of each module. An example of distance-time trajectories for two different sheets is shown in FIG. 5. This trajectory is simply a constant velocity trajectory. As the sheet passes through the different modules, different portions of the trajectory are provided to different modules. Thus for example, module 1 is provided with the trajectory AB and module 2 is provided with the trajectory CD for the sheet. These correspond to the part of the overall trajectory from the time the sheet enters a module to when it completely leaves the module. In the above example the nominal trajectories for two sheets are shown. They have been designed so that the nominal distance between the sheets are fixed at all times and corresponds to the distance EF.

The system controller determines whether the sheets are going into the collision regime. If they are, the information is flagged to the modules involved and corrective action is taken based on a pre-programmed strategy. The module coordination will be done via the use of reference trajectories. These trajectories will embed any constraint that is needed to move the sheet from the module entrance to the exit. When sheets are being handed to another module, the trajectories that are specified to both the modules will be the same for the time period that the sheet is simultaneously in two modules. This will ensure that the actuators of both modules are trying to achieve the same goal namely, moving the sheet on the same trajectory. Hence the sheet will be able to move safely without getting damaged (such as torn-apart or buckled).

While the present invention has been described with reference to various embodiments as described above, it is not confined to the details set forth above, but is intended to cover such modifications or changes as may come within the scope to the attached claims.

What is claimed is:

1. In an image processing apparatus for producing images on copy sheets including a copy sheet path having a plurality of segments, the segments being coupled at given transfer zones, a plurality of copy sheet drives, and a high level controller including a plurality of subcontrollers, each subcontroller directly controlling a given segment of the copy sheet path, a method of controlling the movement of copy sheets along the copy sheet path comprising the steps of:

providing a timing plan by the high level controller for the movement of copy sheets from an entrance to the copy sheet path to an exit of the copy sheet path, continually monitoring the movement of copy sheets within segments of the copy sheet path by each of the subcontrollers, conveying feedback data to the high level controller and to other subcontrollers by each of the subcontrollers on the movement of copy sheets within segments of the copy sheet path, providing instantaneous adjustment data by the high level controller to each of the subcontrollers, and adjusting copy sheet movement by copy sheet drives of selected segments of the copy sheet path in order to substantially achieve said timing plan.

2. The method of claim 1 wherein the timing plan includes both timing and speed elements.

3. The method of claim 1 wherein each of the subcontrollers and copy path segments perform tasks defined by distance and time.

4. The method of claim 3 wherein the tasks include paper inverting, paper transfer, and paper fusing.

5. The method of claim 1 including the step rapidly resolving conflicts between multiple sheets in the copy sheet path.

6. In an image processing apparatus for producing images on copy sheets including a copy sheet path having a plurality of modules, a plurality of copy sheet actuators, and a high level controller including a plurality of subcontrollers, each subcontroller directly controlling a given module of the copy sheet path, a method of controlling the movement of copy sheets along the copy sheet path comprising the steps of:

determining a reference trajectory for sheets in each of the modules by the high level controller, conveying the reference trajectory to each subcontroller, each subcontroller determining a sheet trajectory required to achieve a predetermined accuracy, monitoring the position of sheets within the modules by the subcontrollers, and maintaining the sheets on the sheet trajectory required in a given module by each subcontroller based upon the reference trajectory provided by the high level controller.

7. The method of claim 6 wherein the step of maintaining the sheets on the sheet trajectory required in a given module based upon the reference trajectory is independent of the status of sheets in any module downstream of the given module.

8. The method of claim 6 wherein the step of determining a reference trajectory for sheets in each of the modules by the high level controller includes the step of the high level controller being provided with entrance and exit points of each of the modules.

9. The method of claim 6 wherein the step of determining a reference trajectory for sheets in each of the modules by the high level controller includes the step of the high level controller being provided with the maximum accelerating and retarding force to be applied to a sheet within a given module.

10. The method of claim 6 wherein the step of determining a reference trajectory for sheets in each of the modules by the high level controller includes the step of the high level controller being provided with the response time of a module subcontroller.

11. In an image processing apparatus for producing images on copy sheets including a copy sheet path having a plurality of segments, a plurality of copy sheet drives, and a high level controller including a plurality of subcontrollers, each subcontroller directly controlling a given segment of the copy sheet path, a method of controlling the movement of copy sheets along the copy sheet path comprising the steps of:

providing a target by the high level controller for the movement of copy sheets within the copy sheet path, continually monitoring the movement of copy sheets within segments of the copy sheet path by each of the subcontrollers, conveying feedback data to the high level controller and to other subcontrollers by each of the subcontrollers on the movement of copy sheets within segments of the copy sheet path, and adjusting copy sheet movement by the copy sheet drives of selected segments of the copy sheet path in order to substantially achieve said target.

12. The method of claim 11 wherein the step of adjusting copy sheet movement by the copy sheet drives of selected segments of the copy sheet path in order to substantially achieve said target includes the step of providing instantaneous adjustment data to each of the subcontrollers.

13. The method of claim 11 wherein each of the subcontrollers and copy path segments perform tasks defined by distance and time.

14. The method of claim 13 wherein the tasks include paper inverting, paper transfer, and paper fusing.

15. The method of claim 11 including the step of instantaneously resolving conflicts between multiple sheets in the copy sheet path.

16. An image processing apparatus for producing images on copy sheets comprising:

a copy sheet path having a plurality of segments, a plurality of copy sheet drives for conveying the copy sheets along the segments of the copy sheet path, a high level, discrete controller for planning distance-time trajectories for the copy sheets along the copy sheet path, and a plurality of continuous subcontrollers, each subcontroller directly controlling a given segment of the copy sheet path, for keeping media on the trajectory for each segment of the copy sheet path.

17. The image processing apparatus of claim 16 including sensors to monitor the movement of copy sheets along each segment of the copy sheet path.

18. The image processing apparatus of claim 17 including control logic to convey feedback data from the sensors to the discrete controller and to continuous subcontrollers for adjusting copy sheet movement along the copy sheet path.

19. An image processing apparatus for producing images on media comprising:

a medium path having a plurality of segments, a high level controller for planning distance-time trajectories for media along the segments of the medium path, and a plurality of subcontrollers, each subcontroller directly controlling a given segment of the medium path for keeping the media on the trajectory for segments of the medium path.

20. The image processing apparatus of claim 19 including a plurality of medium drives for conveying media along the segments of the medium path.

21. The image processing apparatus of claim 19 wherein the high level controller is a discrete controller and the subcontrollers are continuous controllers.

22. The image processing apparatus of claim 19 wherein the medium path is a copy sheet path.

23. The image processing apparatus of claim 22 including sensors to monitor the movement of copy sheets along each segment of the copy sheet path.

24. The image processing apparatus of claim 23 including control logic to convey feedback data from the sensors to a discrete controller and to continuous subcontrollers for adjusting copy sheet movement along the copy sheet path.

* * * * *